United States Patent [19]

Brady

[11] 4,391,396

[45] Jul. 5, 1983

[54] CLOTHING TRAVEL BAG

[76] Inventor: Reginald D. Brady, 2524 Boyer Ave. East, Apt. 446, Seattle, Wash. 98102

[21] Appl. No.: 228,132

[22] Filed: Jan. 26, 1981

[51] Int. Cl.[3] ..... A45F 3/02

[52] U.S. Cl. ..... 224/205; 190/41 B; 190/43; 224/202; 224/257; 224/905; 229/56; 294/163

[58] Field of Search ..... 224/201-208, 224/257, 258, 260, 265, 266, 905; 150/2, 12, 33; 190/41 B, 42, 43, 52, 60; 229/56; 294/143, 146, 154-157, 163; 280/814

[56] References Cited

U.S. PATENT DOCUMENTS

| | | | |
|---|---|---|---|
| 650,909 | 6/1900 | Rawlings | 150/2 |
| 1,797,359 | 3/1931 | Meyers | 224/205 |
| 2,340,964 | 2/1944 | Kassner | 224/206 |
| 2,375,643 | 5/1945 | Germanotta | 224/201 |
| 2,672,263 | 3/1954 | Alber | 224/205 |
| 2,813,602 | 11/1957 | MacArthur, Jr. | 150/33 |
| 3,363,826 | 1/1968 | Behler | 229/56 |
| 3,717,188 | 2/1973 | Green | 294/143 |
| 3,796,357 | 3/1974 | Johnson | 224/206 |
| 3,931,917 | 1/1976 | Zellmer | 224/203 |
| 4,126,256 | 11/1978 | McGruder | 224/205 |

FOREIGN PATENT DOCUMENTS

| | | | |
|---|---|---|---|
| 820236 | 11/1937 | France | 229/56 |

*Primary Examiner*—Joseph Man-Fu Moy
*Assistant Examiner*—Gary E. Elkins
*Attorney, Agent, or Firm*—Seed, Berry, Vernon & Baynham

[57] ABSTRACT

A clothing travel bag adapted to be carried over the shoulder of the user. The bag includes a relatively thin, generally rectangular garment bag connected to a substantially smaller, generally rectangular clothes pouch by a relatively thin, flexible web. The intersection between the web and the garment bag is offset from the center of the garment bag to provide clearance for the neck of the user. The angle between the garment bag and clothes pouch is preferably about thirty degrees so that both the bag and the pouch are level when they are carried. A releasable fastener, such as a zipper, releasably secures the web to the garment bag so that the garment bag may be separated from the clothes pouch when articles are to be removed from the bag and pouch.

9 Claims, 2 Drawing Figures

CLOTHING TRAVEL BAG

TECHNICAL FIELD

This invention relates to luggage, and more particularly, to a combination garment bag and clothes pouch adapted to be carried over the shoulder of a user.

BACKGROUND ART

Travel bags for clothing and the like are basically of two varieties. The most commonly used variety is a suitcase in the form of a rectangular box having a carrying handle. Suitcases are highly satisfactory for carrying most types of clothing under most conditions. However, they exhibit serious disadvantages under some circumstances. For example, larger articles of clothing, such as jackets and pants, must be folded before being placed in the suitcase. Where the clothing either is placed in the suitcase for a lengthy period or is tightly packed, the folding often leaves the clothes wrinkled. An even more serious disadvantage of suitcases is the difficulty of carrying them from place to place since the suitcases must be carried by the handle. Yet there are far more efficient techniques for carrying objects since many people, such as women and the elderly, are incapable of lifting heavy loads with their hands. Also, carrying conventional suitcases ties up the hands of individuals so that they are not free to carry other objects, such as travel tickets, etc.

The other commonly used variety of travel bag is known as a "garmet bag." Basically, the garment bag is a relatively thin, rectangular bag having sufficient size to surround coats and slacks in their unfolded condition. The garment bag, being capable of carrying clothing without folding, largely solves the problem of wrinkling associated with suitcases. Garment bags are typically carried by grasping an arcuate hanger projecting from the top of the garment bag. The garment bag is then typically carried by placing the garment bag along the back of an individual who grasps the hanger from the front over one shoulder. Thus garment bags, like suitcases, occupy the hands of an individual, thus preventing other objects, such as travel tickets, from being carried. This problem is more acute in the case of garment bags because garment bags are generally carried carried on-board commercial aircraft, while suitcases are generally checked at the ticket counter. Individuals changing from one plane to another must therefore carry the garment bag the often considerable distance from one airplane gate to another. In contrast, the checked suitcase is transported from one plane to another by airline baggage personnel.

DISCLOSURE OF THE INVENTION

The principal object of the invention is to provide a travel bag for clothes and the like which may be carried by an individual without using the hands and arms of the individual.

It is another object of the invention to provide an easily carried travel bag which is light in weight and relatively inexpensive.

It is still another object of the invention to provide an easily carried travel bag for clothes and the like which minimizes wrinkling of the clothes carried in the bag.

It is a further object of the invention to provide an easily carried travel bag which is specially adapted to carry a wide variety of clothing types.

These and other objects of the invention are provided by a first bag, which may be a conventional garment bag, and a second bag, which may be a substantially smaller clothes pouch. The first and second bags are interconnected by a relatively thin, flexible web which is offset from the center of at least one bag to provide clearance for the neck of a user when the bag is carried with the web over one shoulder and the first and second bags extending downwardly along the back and chest of the user. The inside edge of the web adjacent the neck of the user is substantially longer than the outside edge of the web so that the first and second bags are level when the travel bag is carried by the user. The web preferably includes a pair of reinforcing straps each extending from one corner of a bag to the opposite corner of the other bag so that the straps cross each other near the center of the web. As a result, the weight of the bags is applied to the shoulder near the center of the web so that the web is centered on the shoulder. Additionally, the edges of the web may be scalloped to further concentrate the load near the center of the shoulder. The first and second bags may be releasably secured to each other by a suitable fastener, such as a zipper, so that the bags can be separated from each other when objects are to be removed. The bag is fabricated from relatively inexpensive and lightweight materials, and it does not require an internal frame. The bag is thus light in weight and relatively inexpensive.

BEST MODE FOR CARRYING OUT THE INVENTION

Figure 1:
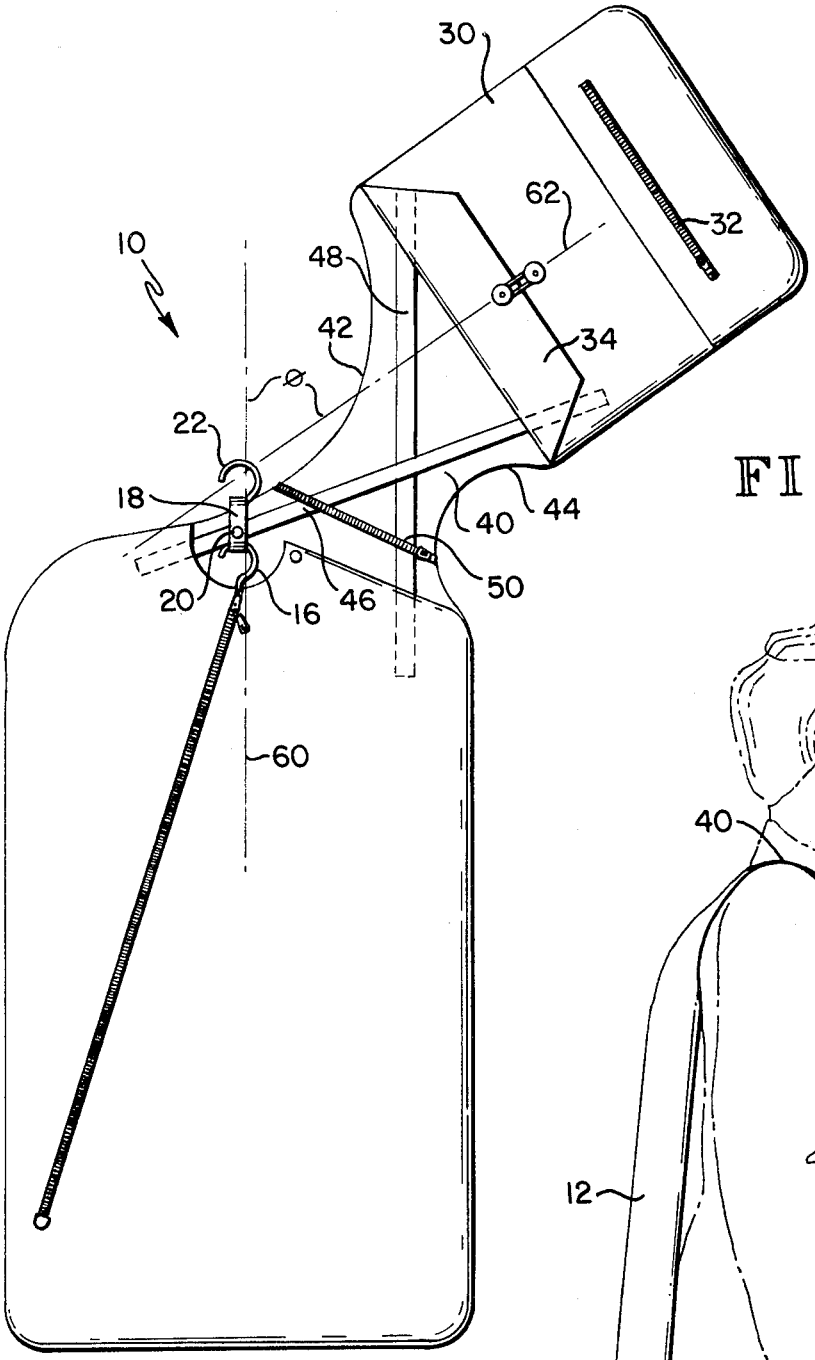
FIG. 1 is a plan view of the travel bag, with the first and second bags occupying a common plane.

The inventive travel bag 10, as best illustrated in FIG. 1, includes a garment bag 12 of conventional size and shape. The garment bag 12 is basically a relatively thin, flexible bag having a size sufficiently large to accommodate a jacket or pants in their unfolded state. Access to the interior of the bag 12 is through a zippered opening 14 or other suitable closure device. Clothing is hung on hangers 16 inside the garment bag 12, and the hangers 16 are supported by a ring 18 secured to the bag 12 with a rivet 20 or other fastener. A hanging hook 22 projects upwardly from the fastening ring 18 to hang the entire travel bag 10 from a clothes rod or other structure.

The travel bag also includes a second bag which may be a clothing pouch 30 having a zippered lower opening 32 and an upper opening closed with a flap 34.

The clothing pouch 30 is secured to the garment bag 12 by a flexible web 40 having a relatively long inside edge 42 and a substantially shorter outer edge 44. The inner edge 42 and outer edge 44 are scalloped inwardly to center the web 40 on the shoulder and to provide greater clearance from the neck and shoulder bone of an individual, as explained in greater detail hereinafter.

A pair of reinforcing straps 46, 48 extend through the web 40. The strap 46 extends from one corner of the garment bag to the opposite corner of the pouch 30, while the other strap 48 extends from the other corner of the travel bag 12 to the opposite corner of the pouch 30. The straps 46,48 thus cross in the center of the web 40. As a result, the weight of the bags 12,30 is concentrated at the center of the web 40 to prevent the edges 42,44 from digging into the shoulder of the user. Concentrating the weight in the center of the web 40 also tends to keep the web 40 centered in the softer, center portion of the shoulder.

When objects are to be removed from the garment bag 12 or clothing pouch 30, it is generally desirable to separate the garment 12 from the pouch 30. Accordingly, a conventional zipper 50 or other releasable fastener secures the web 40 to the upper edge of the garment bag 12 and opposite ends of the straps 46,48 to each other. The clothing pouch 30 and web 40 can thus be separated from the garment bag 12 by unzipping the zipper.

Figure 2:
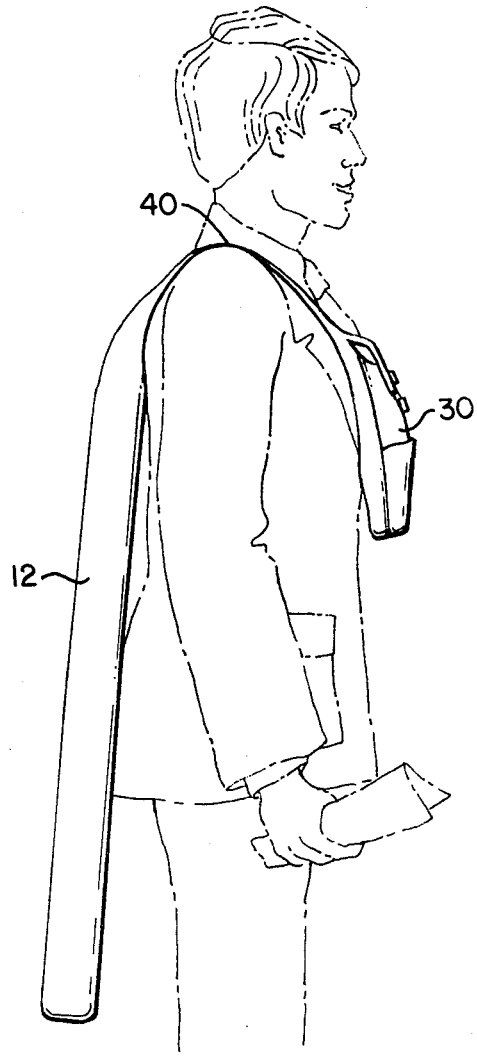
FIG. 2 is an isometric view showing the inventive travel bag being carried by an individual.

The travel bag 10 is carried as illustrated in FIG. 2. The web 40 is positioned over the shoulder of the user, with the inside edge 42 positioned adjacent the user's neck. The garment bag 12 projects downwardly along the back of the user, while the clothing pouch 30 projects downwardly along the user's chest. As mentioned above, the scalloping of the edges 42,44 and the concentration of the weight of the bag 10 at the center of the web 40 centers the web 40 on the shoulder of the user. The weight of the garment bag, coupled with the friction of the web 40 against the shoulder of the user, counterbalances the weight of the clothes pouch 30 so that the bag remains stationary on the shoulder of the user. As a result, the hands of the user are free to carry other objects, such as additional pieces of luggage or travel tickets, etc. As a further advantage, most individuals are able to carry a greater load on their shoulders than in their hands. Consequently, users of the garment bag 10 are able to carry heavier loads than heretofore possible.

Other important features of the inventive travel bag 10 are the offset of the web 40 from the garment bag 10 and the angle at which the center axis of the garment bag 12 intersects the center axis of the clothes pouch 30. As best illustrated in FIG. 1, the web 40 is secured to the garment bag 12 along the upper right edge of the garment bag 12. Offsetting the web 40 to the right side of the garment bag 12 provides clearance for the neck of the user so that the garment bag 12 and clothing pouch 30 are substantially centered along the back and chest of the user. Additionally, the center axis 60 of the garment bag 12 intersects the center axis 62 of the clothing pouch 30 at an acute angle $\theta$ when the garment bag 12 and clothing pouch 30 occupy a common plane, as illustrated in FIG. 1. This angle, coupled with the slope of an individual's shoulders, causes the garment bag 12 and clothing pouch 30 to be level when the web 40 is placed over the shoulder of a user, as illustrated in FIG. 2. Consequently, clothing carried in the garment bag remains centered in the bags. Although the optimum value of the acute angle $\theta$ varies from individual to individual, an angle of about thirty degrees is optimum in most cases, and a range of between twenty to forty degrees is required.

The inventive garment bag 10 is thus light in weight and relatively inexpensive. Further, although the web 40 is illustrated as interconnecting a garment bag 12 and clothing pouch 30, a variety of bag shapes and sizes may be used, depending upon the specific characteristic of the articles to be carried. The particular shape of the web 40 and the manner in which it intersects the bags thus allow relatively heavy bags to be carried in a level position while leaving the hands of the user free.

I claim:

1. A travel bag for carrying objects, comprising first and second bags interconnected by a relatively thin, flexible web, said web being offset from the center of at least one of said bags to provide clearance for the neck of a user when said travel bag is carried with said web over one shoulder and the first and second bags extend downwardly along the back and chest of the user, said web being secured to said bags in a manner that causes the respective center axes of said bags to intersect each other at an acute angle in the direction that said web is offset from said bag when said bags occupy a common plane so that said bags are level when they are carried, with said web resting on the shoulder of said user.

2. The travel bag of claim 1 wherein the acute angle at which the center axes of said bags intersect each other is approximately thirty degrees.

3. The travel bag of claim 1 wherein said first bag is a generally rectangular, relatively thin garment bag and said second bag is a substantially smaller clothes pouch.

4. The travel bag of claim 1, further including a pair of reinforcing straps, each extending from one corner of said first bag to the opposite corner of said second bag such that said straps cross each other near the center of said web to cause the weight of said bags to be applied near the center of said web.

5. The travel bag of claim 1, further including fastening means for releasably securing said first bag to said web so that said bags can be separated from each other when objects are to be removed from said bag.

6. The travel bag of claim 1 wherein said fastening means is a zipper extending along one edge of one of said bags.

7. A clothing travel bag, comprising:

a generally rectangular, relatively thin garment bag having means for hanging articles of clothing therein and an opening on one face thereof to allow access to the interior thereof;

a generally rectangular clothing pouch having a cross-sectional area substantially smaller than the cross-sectional area of said garment bag; and a flexible web extending between said garment bag and said clothing pouch, said web being offset from the center of said garment bag to form a recessed inside edge intersecting said garment bag near its center axis and an outside edge meeting said garment bag near one of its edges to provide clearance between the inside edge of said web and the neck of a user when said travel bag is carried by the user with said web over one shoulder and the garment bag and clothes pouch extending downwardly along the back and chest of the user, the inside edge of said web being substantially longer than the outside edge of said web so that said garment bag and clothes bag are level when said travel bag is carried by said user, the edges of said web being scalloped, said web further including a pair of reinforcing straps extending from one corner of said garment bag to the opposite corner of said clothing pouch so that said straps cross each other near the center of said web such that said web centers itself on the shoulder of said user.

8. The garment bag of claim 1, further including a zipper extending along one edge of said garment bag, said zipper having two separable sides, one of which is secured to said garment bag and the ends of said straps which are secured to said garment bag, and the other side of which is secured to said web and the ends of said straps which are secured to said clothing pouch such that said garment bag may be separated from said web and clothing pouch.

9. A clothing travel bag, comprising:

a generally rectangular, relatively thin garment bag having means for hanging articles of clothing therein and an opening on one face thereof to allow access to the interior thereof;

a generally rectangular clothing pouch having a cross-sectional area substantially smaller than the cross-sectional area of said garment bag; and a flexible web extending between said garment bag and said clothing pouch, said web being offset from the center of said garment bag to form a recessed inside edge intersecting said garment bag near its center axis and an outside edge meeting said garment bag near one of its edges to provide clearance between the inside edge of said web and the neck of a user when said travel bag is carried by the user with said web over one shoulder and the garment bag and clothes pouch extending downwardly along the back and chest of the user, the inside edge of said web being substantially longer than the outside edge of said web so that said garment bag and clothes bag are level when said travel bag is carried by said user, the center axis of said garment bag intersecting the center axis of said clothes pouch at approximately thirty degrees when said bag and pouch occupy a common plane.

* * * * *